US010205220B2

(12) United States Patent
Van Wonterghem

(10) Patent No.: US 10,205,220 B2
(45) Date of Patent: Feb. 12, 2019

(54) WIRELESS COMMUNICATION

(71) Applicant: Nokia Technologies Oy, Espoo (FI)

(72) Inventor: Jari Van Wonterghem, Vancouver (CA)

(73) Assignee: Nokia Technologies Oy, Espoo (FI)

( * ) Notice: Subject to any disclaimer, the term of this patent is extended or adjusted under 35 U.S.C. 154(b) by 64 days.

(21) Appl. No.: 14/909,216

(22) PCT Filed: Jul. 29, 2014

(86) PCT No.: PCT/FI2014/050595
§ 371 (c)(1),
(2) Date: Feb. 1, 2016

(87) PCT Pub. No.: WO2015/015052
PCT Pub. Date: Feb. 5, 2015

(65) Prior Publication Data

US 2016/0218416 A1 Jul. 28, 2016

(30) Foreign Application Priority Data

Aug. 2, 2013 (GB) ..... 1313847.4

(51) Int. Cl.
*H01Q 1/24* (2006.01)
*H01Q 21/28* (2006.01)
(Continued)

(52) U.S. Cl.
CPC ..... *H01Q 1/243* (2013.01); *H01Q 5/35* (2015.01); *H01Q 9/0421* (2013.01); *H01Q 9/42* (2013.01); *H01Q 21/28* (2013.01); *H01Q 1/521* (2013.01)

(58) Field of Classification Search
CPC ..... H01Q 9/0421; H01Q 9/42
See application file for complete search history.

(56) References Cited

U.S. PATENT DOCUMENTS 5,153,600 A 10/1992 Metzler et al.
7,489,276 B2 2/2009 Qi et al.
(Continued)

FOREIGN PATENT DOCUMENTS

CN 201853807 6/2011
EP 2498336 9/2012
(Continued)

OTHER PUBLICATIONS

International Search Report and Written Opinion received for corresponding Patent Cooperation Treaty Application No. PCT/FI2014/050595, dated Oct. 29, 2014, 14 pages.
(Continued)

*Primary Examiner* — Graham Smith
(74) *Attorney, Agent, or Firm* — Alston & Bird LLP

(57) ABSTRACT

An apparatus comprising: a first feed point (26) coupled to a first conductive member (30), the first conductive member being coupled to a ground member (46) in at least two places, the first conductive member and ground member defining a first perimeter (50), wherein the first conductive member and at least a portion of the ground member are configured to resonate at least partially in a first operational frequency band; and a second feed point (28) coupled to a second conductive member (32), the second conductive member being disposed within the first perimeter, the second conductive member and at least a portion of the ground member defining a second perimeter (52) which is smaller than the first perimeter, and being configured to resonate in a second operational frequency band, different to the first operational frequency band.

23 Claims, 10 Drawing Sheets

(51) Int. Cl.

| | |
|---|---|
| ***H01Q 9/04*** | (2006.01) |
| ***H01Q 9/42*** | (2006.01) |
| ***H01Q 5/35*** | (2015.01) |
| *H01Q 1/52* | (2006.01) |

(56) References Cited

U.S. PATENT DOCUMENTS

| | | | |
|---|---|---|---|
| 7,551,142 | B1 | 6/2009 | Zhang et al. |
| 7,903,039 | B2 | 3/2011 | Yu |
| 8,854,273 | B2 | 10/2014 | Li et al. |
| 2002/0180643 | A1 | 12/2002 | Skladany et al. |
| 2002/0190905 | A1 | 12/2002 | Flint et al. |
| 2003/0112195 | A1 | 6/2003 | Cheng et al. |
| 2005/0179596 | A1 | 8/2005 | Higasa et al. |
| 2007/0139270 | A1 | 6/2007 | Takei et al. |
| 2008/0055163 | A1 | 3/2008 | Man et al. |
| 2009/0009401 | A1 | 1/2009 | Suzuki et al. |
| 2009/0091508 | A1 | 4/2009 | Fabrega-sanchez et al. |
| 2009/0189815 | A1 | 7/2009 | Chiu et al. |
| 2009/0231200 | A1 | 9/2009 | Chiu et al. |
| 2013/0057437 | A1 | 3/2013 | Chiu et al. |
| 2015/0116168 | A1* | 4/2015 | Yosui ..... H01Q 7/00 343/722 |

FOREIGN PATENT DOCUMENTS

| | | | |
|---|---|---|---|
| EP | 2328233 | B1 | 3/2017 |
| GB | 2436760 | A | 10/2007 |
| WO | WO 01/91235 | A1 | 11/2001 |
| WO | 0205384 | A1 | 1/2002 |

OTHER PUBLICATIONS

Janssen, E., Increasing Isolation Between Co located Antennas Using a Spatial Notch, Published 2011, pp. 552-555.

Wang, G. et al., "Designer of a Planar Antenna with G-shaped Rings for WLAN/WiMAX" Published Oct. 17-18, 2011, pp. 1-7.

European Search Report received for European Application No. 14832922.0 dated Mar. 8, 2017, 4 pages.

* cited by examiner

WIRELESS COMMUNICATION

RELATED APPLICATION

This application was originally filed as Patent Cooperation Treaty Application No. PCT/FI2014/050595 filed Jul. 29, 2014 which claims priority benefit to GB Patent Application No. 1313847.4, filed Aug. 2, 2013.

TECHNOLOGICAL FIELD

Example embodiments of the present invention relate to apparatus and methods for wireless communication.

BACKGROUND

Apparatus, such as portable electronic devices, usually include an antenna arrangement to enable the portable electronic device to wirelessly communicate with other devices. The antenna arrangement may be provided within a housing of the portable electronic device to shield the antenna arrangement from damage caused by the environment and from contact with the user. Alternatively, the antenna arrangement may comprise a part of a housing of the portable electronic device.

The housing of the portable electronic device defines the exterior surface of the portable electronic device and may at least partly comprise a metal or any other conductive material. Such a housing is relatively strong and may have an attractive aesthetic appearance.

BRIEF SUMMARY

According to various, but not necessarily all, example embodiments of the invention, in a first example embodiment there is provided an apparatus comprising: a first feed point coupled to a first conductive member, the first conductive member being coupled to a ground member in at least two places, the first conductive member and ground member defining a first perimeter, wherein the first conductive member and at least a portion of the ground member are configured to resonate at least partially in a first operational frequency band; and a second feed point coupled to a second conductive member, the second conductive member being disposed within the first perimeter, the second conductive member and at least a portion of the ground member defining a second perimeter which is smaller than the first perimeter, and being configured to resonate in a second operational frequency band, different to the first operational frequency band.

The apparatus may further comprise a first conductive elongate member, wherein the first feed point is coupled to the first conductive member via the first conductive elongate member.

The apparatus may further comprise a second conductive elongate member, wherein the second feed point is coupled to the first conductive member via the second conductive elongate member.

The first conductive member may comprise first and second ends, the first end being disposed opposite the second end, and wherein the first conductive member is coupled to the ground member at a first ground point disposed proximate a first end of the first conductive member and at a second ground point disposed proximate a second end of the first conductive member.

The second feed point may be disposed between the third ground point and the fourth ground point.

The fourth ground point may be disposed closer to the first end of the first conductive member than the second end of the first conductive member.

At least a part of the first conductive member, first feed point, ground member, and second conductive member may define a third perimeter disposed within the first perimeter, wherein the third perimeter is disposed outside of the second perimeter.

The first conductive member may comprise a conductive housing portion of a housing, the housing defining an external surface of the apparatus.

The conductive housing portion may comprise at least a part of at least one of an external lateral side surface and an external longitudinal side surface of a portable electronic device.

The conductive housing portion may be at least a part of a bezel of a portable electronic device.

According to various, but not necessarily all, example embodiments of the invention there is provided a portable electronic device comprising an apparatus as described in any of the preceding paragraphs.

According to various, but not necessarily all, example embodiments of the invention, in a second example embodiment there is provided a method comprising: providing a ground member, a first feed point and a second feed point; providing a first conductive member; coupling the first feed point to the first conductive member; coupling the first conductive member to the ground member in at least two places, such that the first conductive member and ground member define a first perimeter, and wherein the first conductive member and at least a portion of the ground member are configured to resonate in a first operational frequency band; providing a second conductive member; coupling the second feed point to the second conductive member; and coupling the second conductive member to the ground member in at least two places, such that the second conductive member and at least a portion of the ground member define a second perimeter, and the second conductive member and wherein at least a portion of the ground member are configured to resonate in a second operational frequency band, different to the first operational frequency band.

The method may further comprise providing a first conductive elongate member; and coupling the first feed point to the first conductive member via the first conductive elongate member.

The method may further comprise providing a second conductive elongate member; and coupling the second feed point to the second conductive member via the second conductive elongate member.

The first conductive member may comprise a conductive housing portion of a housing, the housing defining an external surface of the apparatus.

The conductive housing portion may comprises at least a part of at least one of an external lateral side surface and an external longitudinal side surface of a portable electronic device.

The conductive housing portion may be at least a part of a bezel of a portable electronic device.

BRIEF DESCRIPTION

For a better understanding of various examples that are useful for understanding the brief description, reference will now be made by way of example only to the accompanying drawings in which.

DETAILED DESCRIPTION

In the following description, the wording 'connect' and 'couple' and their derivatives mean operationally connected or coupled. It should be appreciated that any number or combination of intervening components can exist (including no intervening components). Additionally, it should be appreciated that the connection or coupling may be a physical galvanic connection and/or an electromagnetic connection and/or any other suitable connection.

The housing of a portable electronic device defines the exterior surface of the portable electronic device and may at least partly comprise a metal or any other conductive material. Such a housing is relatively strong and may have an attractive aesthetic appearance.

However, configuring a part of the housing to act as an antenna may limit the number of resonant frequency bands for the antenna arrangement and prevent the portable electronic device from wirelessly communicating with other devices via the antenna arrangement in a plurality of frequency bands.

Figure 2:
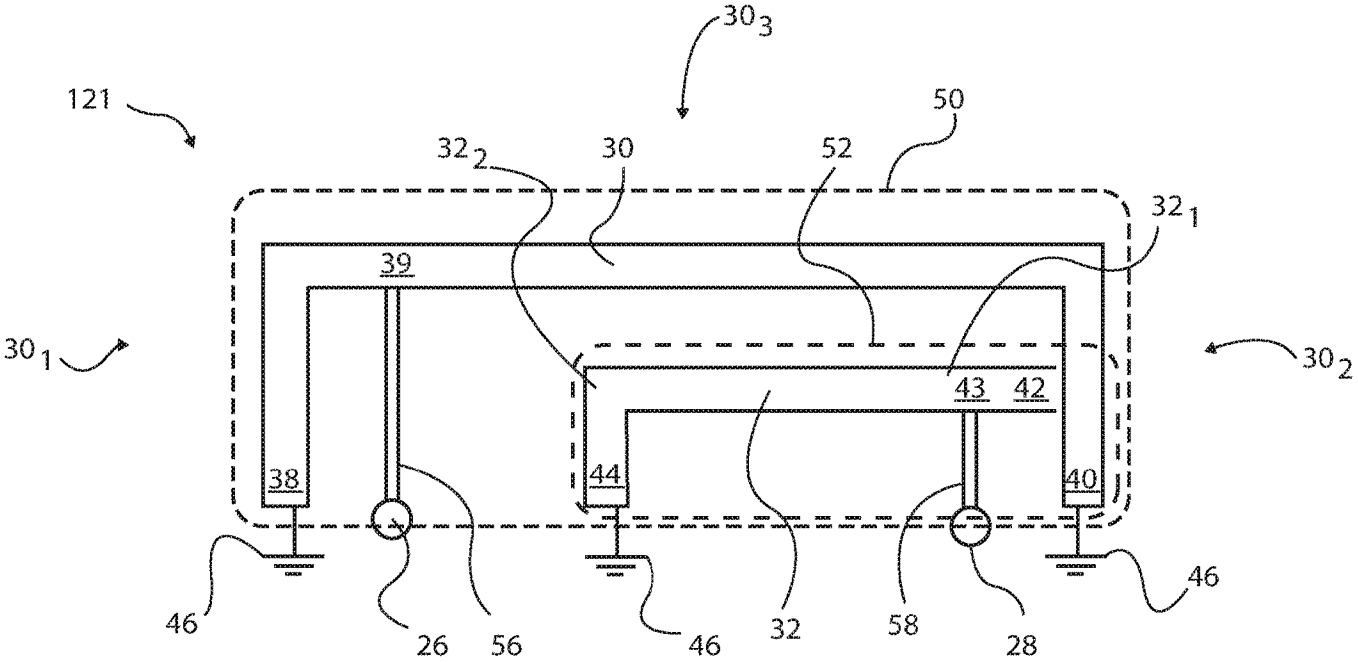
FIG. 2 illustrates a schematic plan view diagram of an apparatus according to various examples.
Figure 4:
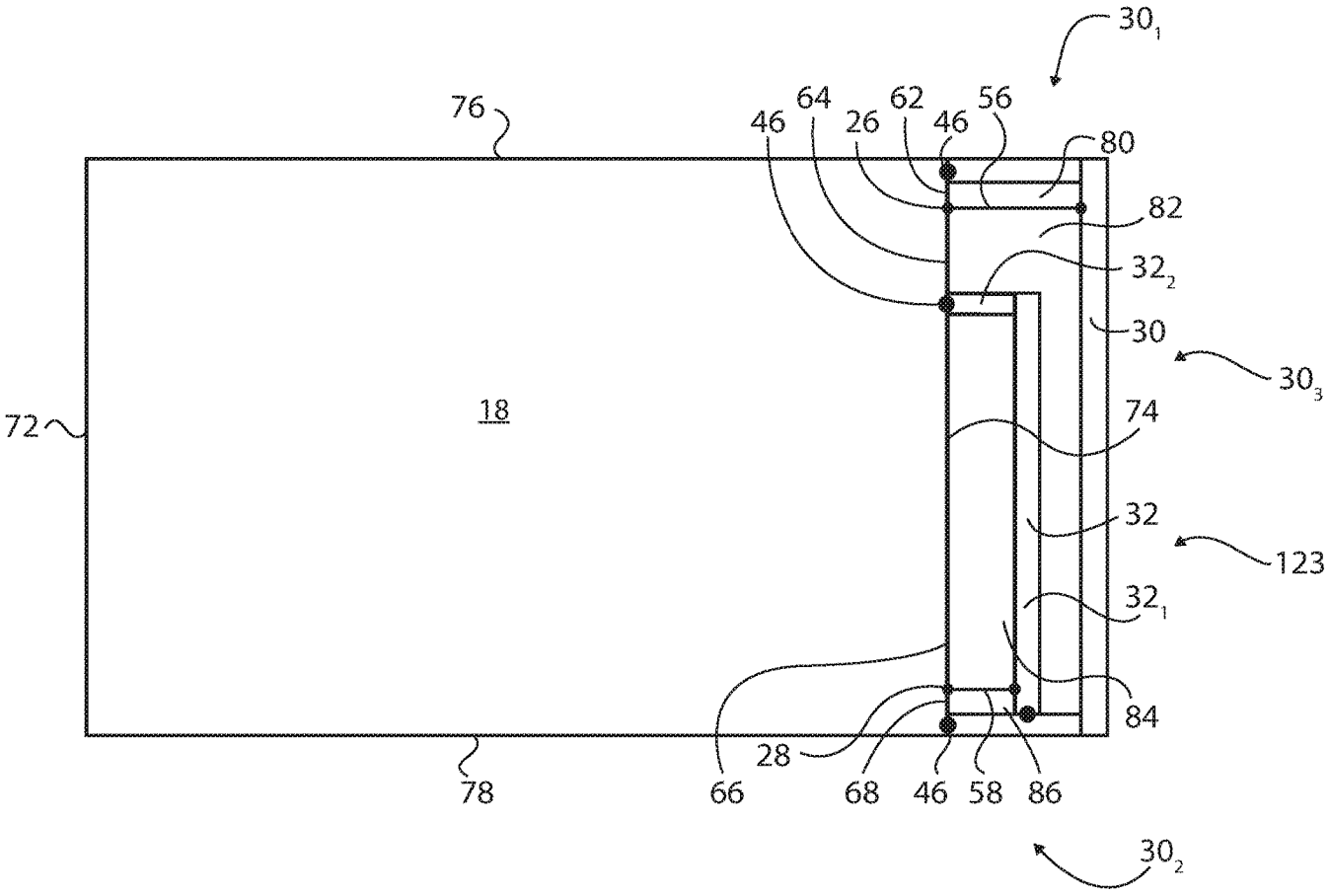
FIG. 4 illustrates a schematic plan view diagram of an alternative apparatus according to various examples.
Figure 5:
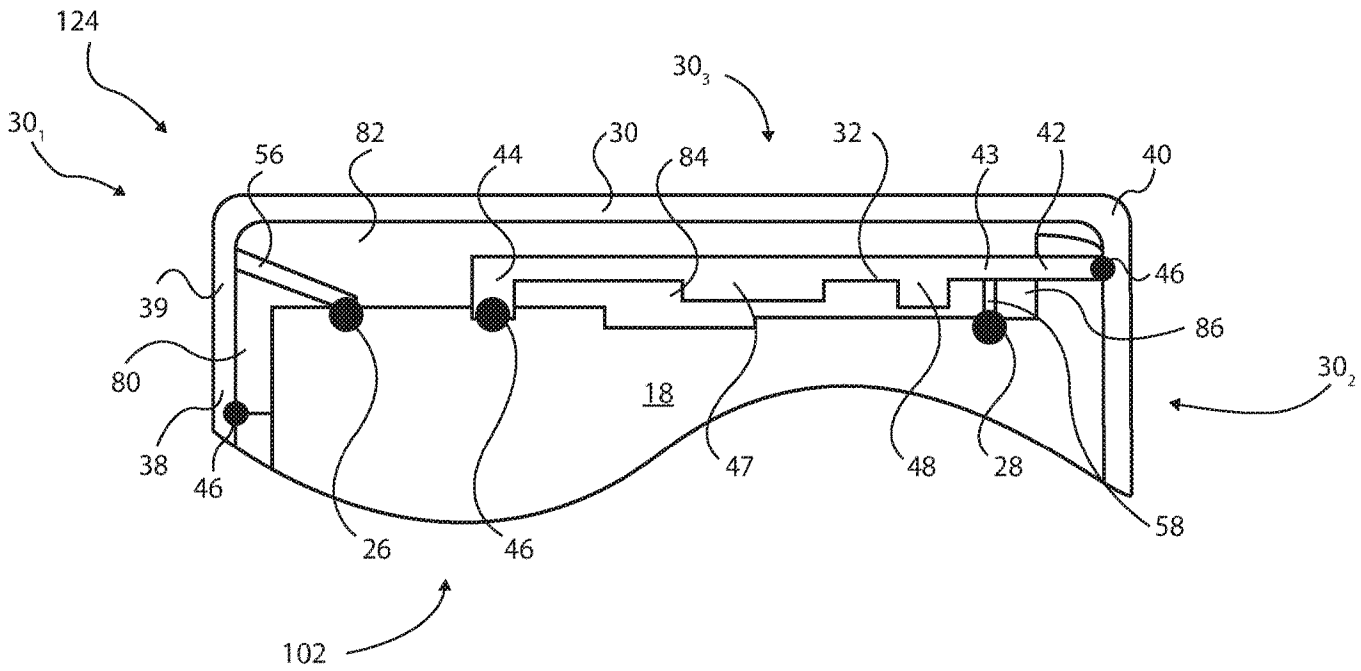
FIG. 5 illustrates a schematic plan view diagram of an alternative apparatus according to various examples.

FIGS. 2, 4, and 5 illustrate an apparatus 121, 123, 125 comprising: a first conductive member being coupled to a ground member in at least two places, the first conductive member and ground member defining a first perimeter, wherein the first conductive member and at least a portion of the ground member is configured to resonate at least partially in a first resonant frequency band; and a second conductive member being configured to be disposed within the first perimeter, the second conductive member and at least a portion of the ground member defining a second perimeter and being configured to resonate in a second resonant frequency band, different to the first resonant frequency band.

Figure 1:
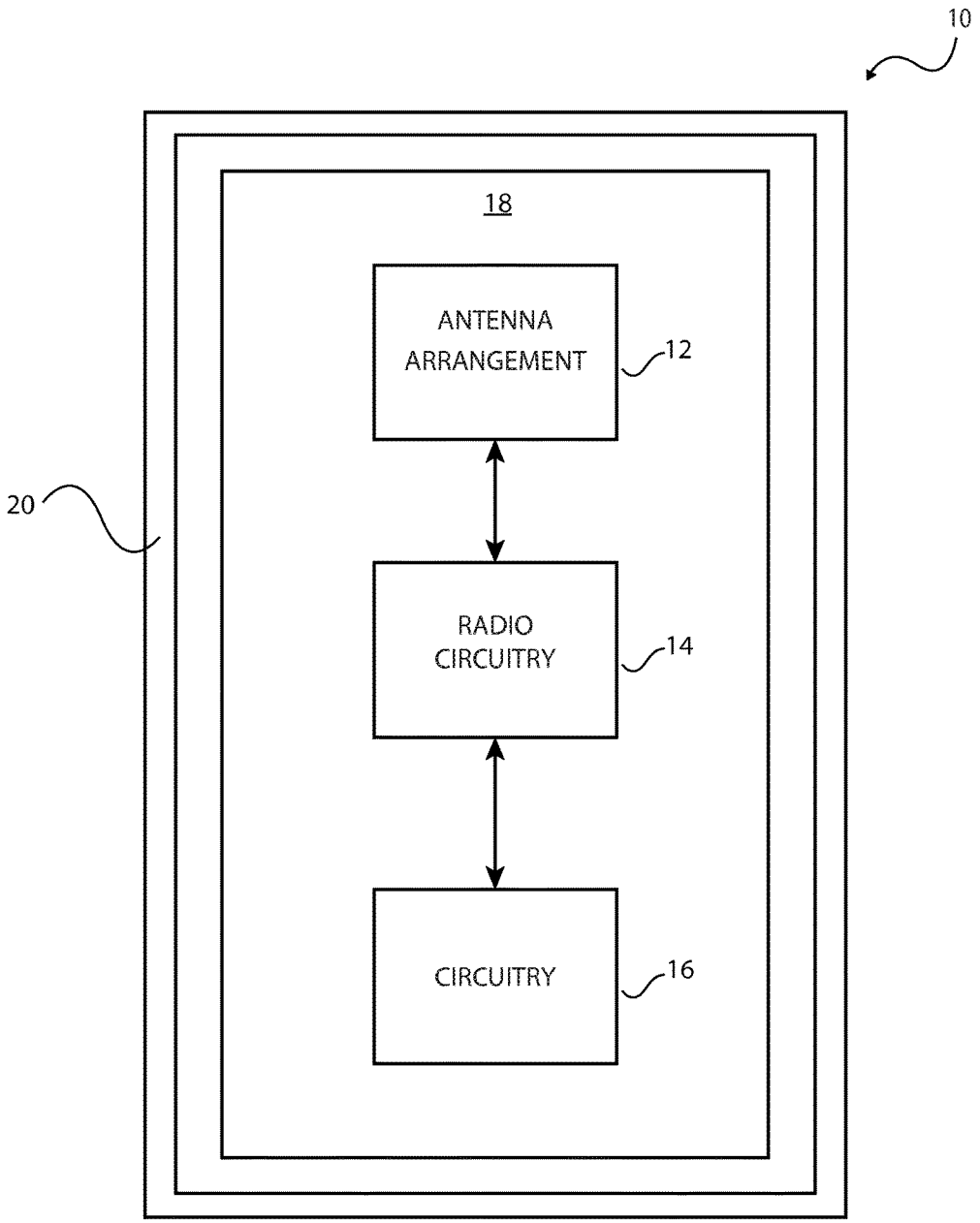
FIG. 1 illustrates a schematic diagram of an electronic communication device according to various examples.

In more detail, FIG. 1 illustrates an electronic communication device 10 which may be any apparatus such as a hand portable electronic device (for example, a mobile cellular telephone, a tablet computer, a laptop computer, a personal digital assistant or a hand held computer), a non-portable electronic device (for example, a personal computer or a base station for a cellular network), a portable multimedia device (for example, a music player, a video player, a game console and so on) or a module for such devices. As used here, the term 'module' refers to a unit or apparatus that excludes certain parts or components that would be added by an end manufacturer or a user.

The electronic communication device 10 comprises an antenna arrangement 12, radio circuitry 14, other circuitry 16, a ground member 18 and a housing 20. The antenna arrangement 12 includes one or more antennas that are configured to transmit and receive, transmit only or receive only electromagnetic signals. The radio circuitry 14 is connected between the antenna arrangement 12 and the other circuitry 16 and may include a receiver and/or a transmitter. The other circuitry 16 is operable to provide signals to, and/or receive signals from the radio circuitry 14. The electronic device 10 may optionally include one or more matching circuits, filters, switches, or other radio frequency circuit elements, and combinations thereof, between the antenna arrangement 12 and the radio frequency circuitry 14.

The radio frequency circuitry 14 and the antenna arrangement 12 may be configured to operate in a plurality of operational frequency bands. For example, the operational frequency bands may include (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

A frequency band over which an antenna can efficiently operate using a protocol is a frequency range where the antenna's return loss is less than an operational threshold. For example, efficient operation may occur when the antenna's return loss is better than (that is, less than) −4 dB or −6 dB.

The other circuitry 16 may include processing circuitry (for example a micro-processor), memory circuitry and input/output devices such as an audio input device (a microphone for example), an audio output device (a loudspeaker for example), a display and a user input device (such as a touch screen display and/or one or more buttons or keys).

The antenna arrangement 12 and the electronic components that provide the radio frequency circuitry 14 and the other circuitry 16 may be interconnected via the ground member 18 (for example, a printed wiring board). The ground member 18 may be used as a ground plane for the antenna arrangement 12 by using one or more layers of the printed wiring board (PWB). In other example embodiments, some other conductive part of the electronic device 10 (a battery cover or a chassis within the interior of the housing 20 for example) may be used as the ground member 18 for the antenna arrangement 12. In some examples, the ground member 18 may be formed from several conductive parts of the electronic device 10, one part which may include the printed wiring board. The ground member 18 may be planar or non-planar.

The housing 20 defines one or more exterior visible surfaces of the electronic device 10 and also has an interior surface that defines a cavity configured to house the electronic components of the electronic device 10 such as the antenna arrangement 12, the radio frequency circuitry 14, the other circuitry 16 and the ground member 18. The housing 20 comprises a conductive housing portion that may form part or all of the housing 20. Furthermore, in some example embodiments the housing 20 may comprise a plurality of conductive housing portions that may or may not be galvanically connected to one another. The conductive housing portion may comprise any conductive material and may comprise one or more metals and/or one or more conductive polymers for example.

The apparatus 121 is described in the following paragraphs with reference to several examples.

Figure 3:
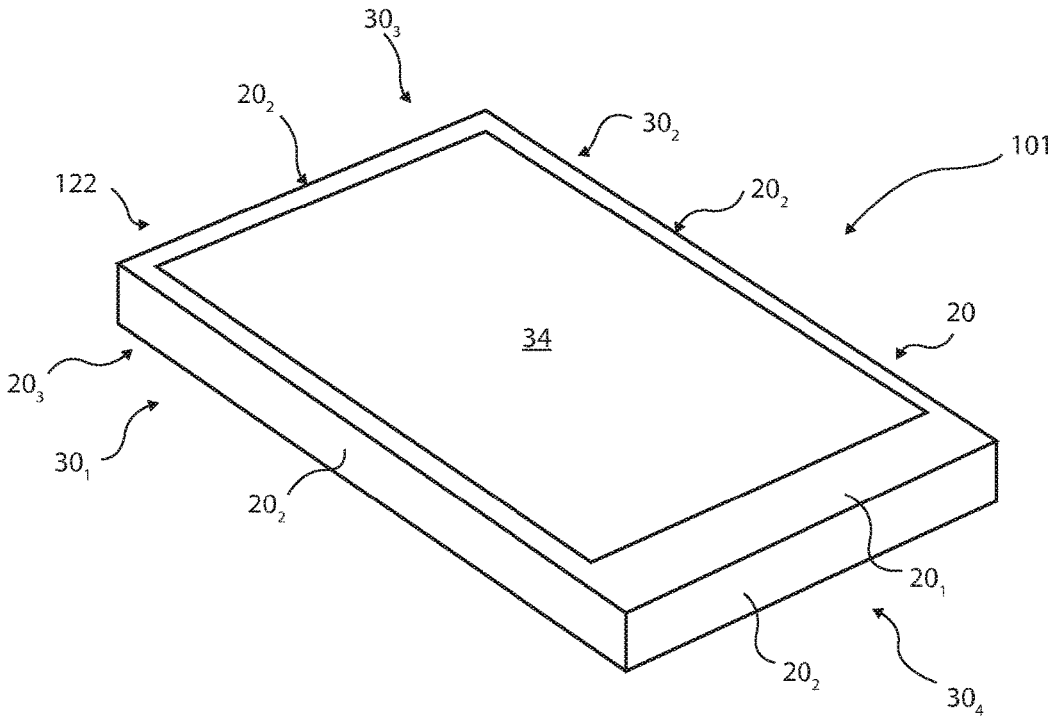
FIG. 3 illustrates a perspective view diagram of an exterior of a portable electronic device according to various examples.

FIG. 2 illustrates a schematic plan view diagram of an apparatus 121. The apparatus 121 includes a first conductive member 30, a second conductive member 32, a first feed point 26, a first conductive elongate member 56, a second conductive elongate member 58 and a second feed point 28. In this example, the apparatus 121 is planar. However, in other examples, the apparatus 121 may extend in three dimensions and be non-planar (as illustrated in FIG. 3).

The first conductive member 30, second conductive member 32, first conductive elongate member 56 and second conductive elongate member 58 may comprise any suitable material having a relatively high electrical conductivity. For example, the first conductive member 30, second conductive member 32, first conductive elongate member 56 and second conductive elongate member 58 may comprise a metal such as aluminum, or other conductive material such as graphite, carbon, conductive polymer, and conductive composite materials and so on. Additionally or alternatively, the first conductive member 30, second conductive member 32, first conductive elongate member 56 and second conductive elongate member 58 may include a conductive layer (a metal layer for example) which is coated with plastic or may include a plastic layer that is coated or that otherwise carries a conductive layer (a metal layer for example).

The first conductive member 30 may form at least a part of the housing 20 of the electronic device 10 (and may consequently be referred to as a conductive housing portion). For example, the conductive housing portion 30 may form a bezel or frame that extends around the perimeter of the electronic device 10 (that is, the conductive housing portion 30 comprises at least a part of an edge or side surface of the electronic device 10). Alternatively, the conductive housing portion 30 may form an upper or lower surface of the electronic device 10. In some examples, the first conductive member 30 may not form a part of the housing 20 and may instead be housed within the housing 20, where the part of the housing 20 which overlies the first conductive member 30 may be made from a non-conductive material, for example plastic or other such non-conductive materials.

As illustrated in FIG. 2, the first conductive member 30 has a first end 38 and a second end 40, opposite to the first end 38. The first conductive member 30 defines at least a first edge $\mathbf{30}_1$, a second edge $\mathbf{30}_2$ and a third edge $\mathbf{30}_3$ of the apparatus 121, as illustrated in FIG. 2. The first and second edges $\mathbf{30}_1$, $\mathbf{30}_2$ are shorter than the third edge $\mathbf{30}_3$. In other example embodiments the first and second edges $\mathbf{30}_1$, $\mathbf{30}_2$ may be longer than the third edge $\mathbf{30}_3$. Although in FIG. 2 the first and second edges $\mathbf{30}_1$, $\mathbf{30}_2$ are illustrated as having the same length, in other example embodiments they may have different lengths.

In other example embodiments, for example as illustrated in FIG. 3, the first and second edges $\mathbf{30}_1$, $\mathbf{30}_2$ may form at least a part of the external longitudinal side surface or wall of the apparatus 121, and the third edge $\mathbf{30}_3$ may form the external lateral side surface or wall of the apparatus 121. This will be described in more detail later with reference to FIG. 3.

The third edge $\mathbf{30}_3$ is galvanically connected between the first $\mathbf{30}_1$ and second $\mathbf{30}_2$ edges of the first conductive member 30. The first conductive member 30 is coupled to ground 46 at least in two places. The first conductive member 30 is coupled to ground 46 at the first end 38 and also at the second end 40 of the first conductive member 30, as illustrated in FIG. 2.

The first feed point 26 is coupled at a first coupling point 39 of the first conductive member 30, the first coupling point 39 being disposed along the first conductive member 30 between the first end 38 and the second end 40 of the first conductive member 30. In FIG. 2 the coupling point 39 is closer to the first end 38 than the second end 40, that is the coupling point 39 is proximate the first end 38. In other example embodiments the coupling point 39 may be disposed along the first conductive member 30 closer or further from the first end 38 of the first conductive member 30. The first feed point 26 is coupled to the coupling point 39 of the first conductive member 30 via a first conductive elongate member 56. The first conductive elongate member 56 is illustrated as a straight conductive coupling member in FIG. 2, but in other example embodiments the first conductive elongate member 56 may be any suitable shape and may be curved or meandered or any combination of straight and curved shapes.

A second conductive member 32 is disposed between the first conductive member 30 and the ground 46. The second conductive member 32 has a first end 42 and a second end 44, opposite to the first end 42. The first end 42 of the second conductive member 32 is coupled to ground 46, via the first conductive member 30, in close proximity to the second end 40 of the first conductive member 30. In the example of FIG. 2 the first end 42 of the second conductive member 32 is coupled to the second edge $\mathbf{30}_2$ of the first conductive member 30. In other example embodiments the first end 42 of the second conductive member 32 may be coupled to the first conductive member 30 anywhere between the first end 40 and the coupling point 39 of the first conductive member 30, and alternatively may be coupled directly to the second end 40 of the first conductive member 30 and thus directly coupled to ground 46. The second end 44 of the second conductive member 32 is coupled to ground 46.

Dielectric material (not illustrated in FIG. 2) may be placed between the second conductive member 32, the first conductive member 30 and the ground 46, such as and not limited to, plastic, ceramic, ferrite, printed wiring board materials (for example, FR4 which is a composite material comprising woven fiberglass cloth with an epoxy resin binder that is flame resistant, or any other glass epoxy based laminate), and other non-conducting materials suitable for antennas as known in the art. The dielectric material may additionally act as a mechanical support to one or more of the components of the apparatus 121. Alternatively, the dielectric material may be air when the second conductive member 32 is mechanically robust enough to be self-supporting within the apparatus 121.

The first conductive member 30 and the ground 46 also defines a first perimeter 50 within which the second conductive member 32 is disposed. The second conductive member 32 comprises a substantially L-shaped conductive member having a first portion $\mathbf{32}_1$ which is disposed substantially in parallel with the third edge $\mathbf{30}_3$ of the first conductive member 30 and forming a gap therebetween and a second portion $\mathbf{32}_2$ which is disposed substantially in parallel with the first edge $\mathbf{30}_1$ of the first conductive member 30 and forming a gap between the second portion $\mathbf{32}_2$ and the first conductive elongate member 56. The second conductive member 32 may, in other example embodiments, comprise any suitable shape that fits within the perimeter 50.

The second feed point 28 is coupled at a second coupling point 43 of the second conductive member 32, the second coupling point 43 being disposed along the second conductive member 32 between the first end 42 and the second end 44 of the second conductive member 32. In FIG. 2 the coupling point 43 is closer to the first end 42 than the second end 44. In other example embodiments the coupling point 43 may be disposed along the second conductive member 32 closer or further from the first end 42 of the second conductive member 32. The second feed point 28 is coupled to the coupling point 43 of the second conductive member 32 via a second conductive elongate member 58. The second conductive elongate member 58 is illustrated as a straight conductive coupling member in FIG. 2, but in other example embodiments the first conductive elongate member 58 may be any suitable shape and may be curved or meandered or any combination of straight and curved shapes.

Not illustrated in FIG. 2 for clarity, the radio circuitry 14 as illustrated in FIG. 1 may be coupled to the first conductive member 30 and to the second conductive member 32 respectively via the first 26 and second 28 feed points. Intervening radio frequency (RF) components, for example and not limited to, resistors, inductors, capacitors, filters, switches, isolators, circulators, and directional couplers, may be required between the feed points 26, 28 and the radio circuitry (also not illustrated in FIG. 2). Intervening RF components may also comprise transmission lines, for example and not limited to, stripline, microstrip line, coplanar waveguide (CPW), and coaxial cables, which may be needed to transport or couple RF signals between the radio circuitry 14 and the feed points 26, 28. The feed points 26, 28 may be disposed on a PWB in the form of conductive contact pads. The first feed point 26 and the first conductive elongate member 56 are configured to couple RF signals between the first conductive member 30 and the radio circuitry 14. The second feed point 28 and the second conductive elongate member 58 are configured to couple RF signals between the second conductive member 32 and the radio circuitry 14. The radio circuitry 14 may comprise one or more radios in the form of one or more receiver, one or more transmitter and/or one or more transceiver. The first and second feed points 26, 28 may be coupled to the same radio circuitry, in other words, to the same one or more receiver, transmitter and/or transceiver. Alternatively, first and second feed points 26, 28 may be coupled to different radio circuitry, in other words, the first feed point 26 may be coupled to first radio circuitry comprising one or more first receiver, first transmitter and/or first transceiver and the second feed point 28 may be coupled to second radio circuitry comprising one or more second receiver, second transmitter and/or second transceiver. First and second radio circuitry may be combined into a single radio circuitry integrated circuit or module or they may be separate. In an embodiment the first radio frequency signals may be global positioning system (GPS) signals and the second radio frequency signals may be wireless local area network (WLAN) signals.

The first conductive member 30 in combination with at least a part of the ground 46 is configured to operate as a first antenna in at least a first operational frequency band (which may, for example, be any of the operational frequency bands mentioned above). The first antenna has an electrical length that includes the physical length of the first conductive member 30 from the first end 38 to the second end 40 and the physical length along the ground 46 between the first and second ends 38, 40. The first antenna may form a slot antenna.

The second conductive member 32 in combination with at least a part of the ground 46 is configured to operate as a second antenna in at least a second operational frequency band (which may be any of the operational frequency bands mentioned in the preceding paragraphs). The second antenna has an electrical length that includes the physical length of the second conductive member 32 from the first end 42 to the second end 44 and the physical length along the ground 46 between the first and second ends 42, 44, and optionally at least a part of the first conductive member 30. The second antenna may form a slot antenna. As an example the first and second operational frequency bands may be GPS (1570.42-1580.42 MHz) and WLAN (2400-2483.5 MHz) respectively.

The first conductive member 30 may have an electrical length which is half a wavelength long. The physical length of the third edge $\mathbf{30}_3$ of the first conductive member 30 may determine the half wavelength at the GPS 1.575 GHz operational frequency. Half a wavelength at 1.575 GHz is approximately 95 mm in free space. The required physical length depends on the mechanical construction and dielectric material properties within and around the first conductive member 30. However, in some example embodiments the physical length may be shorter or longer than the required electrical length and this may be compensated for by adding reactive components to electrically shorten or lengthen the physical length. The electrical length and hence resonant frequency can also be tuned by fixed distributed tuning elements as part of the first conductive member 30 (as illustrated in FIG. 5), as will be explained with reference to FIG. 5.

The second conductive member 32 may have an electrical length which is half a wavelength long. The physical length of the first portion $\mathbf{32}_1$ of the second conductive member 32 may determine the half wavelength at the WLAN 2.4 GHz operational frequency. Half a wavelength at 2.4 GHz is approximately 61 mm in free space. The required physical length depends on the mechanical construction and dielectric material properties within and around the first conductive member 30. However, in some example embodiments the physical length may be shorter or longer than the required electrical length and this may be compensated for by adding reactive components to electrically shorten or lengthen the physical length. The electrical length and hence resonant frequency can also be tuned by fixed distributed tuning elements as part of the first conductive member 30 (as illustrated in FIG. 5), as will be explained with reference to FIG. 5.

As the second antenna (WLAN antenna) is physically smaller than the first antenna (GPS antenna), advantageously the second antenna (WLAN antenna) is configured to nest within the first antenna (GPS antenna). Advantageously, the half wave structure of each of the first and second antennas provides good isolation between the two antennas. In particular, the first coupling point 39 is disposed in proximity to a first end 38 of the first conductive member 30 of the first antenna, which is closer to the second end 44 of the second conductive member 32 of the second antenna than the first end 42 of the second conductive member 32 of the second antenna. Further, the second coupling point 43 is disposed in proximity to a first end 42 of the second conductive member 32 of the second antenna than the first end 38 of the first conductive member 30 of the first antenna. This advantageously keeps the feed points 26, 28 at opposite ends of the overall antenna arrangement 12 such that the current distributions in each antenna are setup so that electromagnetic coupling between the two antennas is minimised and isolation is maximized.

FIG. 3 illustrates a perspective view diagram of an exterior of a portable electronic device 101 according to various examples. The portable electronic device 101 is similar to the electronic device 10 and where the features are similar, the same reference numerals are used. The portable electronic device 101 may be (for example, but not limited to) a mobile cellular telephone or a tablet computer.

The portable electronic device 101 includes a housing 20, an apparatus 122, and a display 34. The housing 20 defines the exterior surface of the portable electronic device 101 and includes an upper surface $\mathbf{20}_1$ that surrounds the display 34, a side wall $\mathbf{20}_2$ (which may also be referred to as a bezel), and a bottom surface $\mathbf{20}_3$. The side wall $\mathbf{20}_2$ extends around the perimeter of the upper and lower surfaces $\mathbf{20}_1$, $\mathbf{20}_3$. The side wall $\mathbf{20}_2$ may be electrically coupled to one or more points around the perimeter of the upper and lower surfaces $\mathbf{20}_1$, $\mathbf{20}_3$. The apparatus 122 is located at one end of the side wall $\mathbf{20}_2$ of the portable electronic device 101.

At least a part of the side surface $\mathbf{20}_2$ comprises the first conductive member 30 illustrated in FIG. 2 and therefore comprises a conductive material such as a metal. The upper surface $\mathbf{20}_1$ and the lower surface $\mathbf{20}_3$ may comprise any suitable material and may comprise one or more portions of a metal, a plastic and/or a glass for example.

The first conductive member 30 therefore defines at least a part of a first edge $\mathbf{30}_1$, a part of a second edge $\mathbf{30}_2$ and a part of a third edge $\mathbf{30}_3$ of the apparatus 122, as illustrated in FIG. 3. The fourth edge $\mathbf{30}_4$ is also illustrated in FIG. 3.

The structure of the apparatus 122 is described in greater detail in the following paragraphs with reference to FIGS. 4 and 5.

FIG. 4 illustrates a schematic plan diagram of an alternative apparatus 123 according to various examples. The apparatus 123 is similar to the apparatus 121, 122 illustrated in FIGS. 2 and 3 and where the features are similar, the same reference numerals are used.

The ground member 18 is illustrated in FIG. 4 as a solid conductive layer or area defined by at least one layer of a printed wiring board (PWB). The ground member 18 provides the ground plane and grounds 46 for the apparatus 123. The ground member 18 is rectangular in shape, but in other example embodiments may be any shape either in two dimensions or three dimensions. The ground member 18, as illustrated in FIG. 4, comprises four edges 72, 74, 76 and 78. The first edge 72 is disposed in parallel to the second edge 74 and the third edge 76 is disposed in parallel to the fourth edge 78. The first and second edges 72, 74 are orthogonal to the third and fourth edges 76, 78. In other example embodiments, the ground member 18 may be disposed on a layer of a PWB having an area which is smaller than the total area of the layer of the PWB.

The second edge 74 of the ground member 18 comprises at least four edge portions 62, 64, 66, 68. The second edge 74 has a length which is divided between the at least four edge portions 62, 64, 66, 68 by the various grounds 46 and feed points 26, 28 of the antenna arrangement 12. The first edge portion 62 is disposed between the first end 38 of the first conductive member 30 and the first feed point 26. The second edge portion 64 is disposed between the first end 44 of the second conductive member 32 and the first feed point 26. The third edge portion 66 is disposed between the first end 44 of the second conductive member 32 and the second feed point 28. The fourth edge portion 68 is disposed between the second end 40 of the first conductive member 30 and the second feed point 28.

The apparatus 123 forms four distinct non-conductive apertures 80, 82, 84 and 86. The first aperture 80 is defined by the first edge portion 62, the first conductive elongate member 56, the first coupling point 39 and at least a portion of the first conductive member 30. The second aperture 82 is defined by the second edge portion 64, the first conductive elongate member 56, the first coupling point 39, at least a portion of the first conductive member 30, and at least a portion of the second conductive member 32. The third aperture 84 is defined by the third edge portion 66, the second conductive elongate member 58, the second coupling point 43 and at least a portion of the second conductive member 32. The fourth aperture 86 is defined by the fourth edge portion 68, the second conductive elongate member 58, the second coupling point 43, at least a portion of the second conductive member 32, and optionally at least a portion of the first conductive member 30.

The first aperture 80 defines the feed arrangement for the first antenna and the fourth aperture 86 defines the feed arrangement for the second antenna. The second aperture 82 provides the necessary area and/or volume to configure the first antenna to operate in the first operational frequency band. The second aperture 82 is illustrated in FIG. 4 as being substantially L-shaped but in other example embodiments the second aperture 82 may be any shape. The third aperture 84 provides the necessary area and/or volume to configure the second antenna to operate in the second operational frequency band. The third aperture 84 is smaller than the second aperture 82. The first and fourth apertures 80, 86 are smaller than the second and third apertures 82, 84. Although the apertures 80, 82, 84 and 86 are illustrated in FIG. 4 as being substantially rectangular, any or all of the apertures may be any regular or irregular shape in other example embodiments.

All of the apertures 80, 82, 84 and 86 define the first perimeter 50 (as illustrated in FIG. 2). The third and fourth apertures 84, 86 define the second perimeter 52.

FIG. 5 illustrates a schematic plan diagram of an alternative apparatus 124 according to various examples. The apparatus 124 is similar to the apparatus 121, 122, 123 illustrated in FIG. 2, FIG. 3 and FIG. 4 and where the features are similar, the same reference numerals are used.

FIG. 5 illustrates the apparatus 124 as part of a portable electronic device 102, which may be a mobile cellular telephone or a tablet computer or any portable electronic device. In the example embodiment the first conductive member 30 comprises a conductive housing portion 30 of the portable electronic device 102. The conductive housing portion 30 forms at least a part of the external housing which houses and protects the electronic components, for example and not limited to, the ground member 18, the radio circuitry 14 and other circuitry 16, disposed within the device. Although in FIG. 5 the conductive housing portion 30 is not illustrated as having a non-conductive support structure on the internal surface thereof, such a non-conductive support structure could be provided in other example embodiments. This may be to provide a substrate which is metallized on an external surface thereof to provide the conductive housing portion 30.

The conductive housing portion 30 comprises both external longitudinal and lateral edge wall portions. The first edge $\mathbf{30}_1$ and second edge $\mathbf{30}_2$ of the conductive housing portion 30 continue to follow the periphery of the portable electronic device 10 (not illustrated in FIG. 5) along the longitudinal edge to form a unitary conductive housing portion having no non-conductive gaps along its length, and may form part or all of the side walls $\mathbf{20}_2$ (as illustrated in FIG. 3). This may provide a further benefit in that the conductive housing portion 30 may provide a solid continuous, in other words uninterrupted, aesthetically pleasing appearance to a side edge or surface of the portable electronic device 102.

The ground member 18 is comprises at least one layer of the printed wiring board (PWB) of the device 102 and is disposed wholly within the perimeter provided by the internal surface of the conductive housing portion 30. The second conductive member 32 comprises metal, for example stainless steel, which is electrically and mechanically coupled between the conductive housing portion 30 and the ground member 18. The second conductive member 32 may be made from any conductive material suitable for conducting RF signals, for example and not limited to copper, stainless steel, nickel, gold, silver, tin, beryllium copper, aluminum, and so on. As the conductive housing portion 30 is providing an external surface of the device 102, it must be made from a mechanically rigid and strong conductive material, for example and not limited to, stainless steel. The conductive elongate members 56, 58 are also provided by a suitable electrical and mechanical material, as mentioned above.

As can be seen in FIG. 5, the apertures 80, 82, and 84 are not rectangular in shape and take the form of the surrounding components within the device 102. The first aperture 80 is a substantially L-shaped polygon, whilst the second and third apertures 84, 86 are polygonal having multiple sides.

The feed points 26, 28 may be provided by a copper plated pad on the surface of the PWB, which must not be short circuited to the ground member 18. The feed points 26, 28 will then be coupled to the radio circuitry 14 via further printed copper traces of the PWB (not illustrated in FIG. 5). The conductive elongate members 56, 58 may be coupled to the feed points 26, 28 either directly by galvanic or capacitive coupling means or via an intervening component (not illustrated), for example a spring clip.

The conductive housing portion 30 and the second conductive member 32 form the first and second antennas respectively as described with reference to FIGS. 2 and 4 previously. The first conductive member 30 in combination with at least a part of the ground member 18 is configured to operate as a first antenna in at least a first operational frequency band (which may be any of the operational frequency bands mentioned in the preceding paragraphs). The first antenna has an electrical length that includes the physical length of the first conductive member 30 from the first end 38 to the second end 40 and the physical length along the second edge 74 of the ground member 18 between the first and second ends 38, 40. The first antenna may form a slot antenna. The second conductive member 32 in combination with at least a part of the ground member 18 is configured to operate as a second antenna in at least a second operational frequency band (which may be any of the operational frequency bands mentioned in the preceding paragraphs). The second antenna has an electrical length that includes the physical length of the second conductive member 32 from the first end 42 to the second end 44 and the physical length along the second edge 74 of the ground member 18 between the first and second ends 42, 44, and optionally at least a part of the first conductive member 30. The second antenna may form a slot antenna. As an example the first and second operational frequency bands may be GPS (1570.42-1580.42 MHz) and WLAN (2400-2483.5 MHz) respectively.

The second conductive member 32 optionally comprises first and second conductive tuning elements 47, 48 which may be disposed anywhere along the length of the second conductive member 32. The tuning elements 47, 48 each comprise a conductive portion which is shaped and located along the second conductive member 32, so that an open end of the one or more conductive tuning element capacitively couples to the ground member 18 across one or more non-conductive gap. The conductive tuning element 47, as an example, may be physically dimensioned and located to fine tune the first (half wave) mode, resonant at 2.5 GHz, of the second antenna (WLAN). The second conductive tuning element 48, as a further example, may be physically dimensioned and located to fine tune the first harmonic (full wavelength) mode, resonant at 5 GHz, of the second antenna (WLAN antenna). The conductive tuning elements 47, 48 are illustrated in FIG. 5 as fixed and integrated portions of the second conductive element 32. In other example embodiments, the conductive tuning elements 47, 48 may be separate parts which are attached to the second conductive element 32 by soldering, welding, screwing, gluing, clipping, or by other attachment methods. The conductive tuning elements 47, 48 provide the advantage that the second conductive member 32 may be tuned without increasing the overall length and/or area of the second antenna.

In FIG. 5 the ground member 18 is electrically coupled to the one or more external longitudinal or lateral edge wall portions provided by the conductive housing portion 30, via one or more ground points 46 around the perimeter of the ground member 18.

Alternatively, the one or more external longitudinal or lateral edge wall portions provided by the conductive housing portion 30 may be continuously coupled around the perimeter of the ground member 18, forming a continuous solid electrical ground seam between the ground member 18 and the one or more external longitudinal or lateral edge wall portions rather than via more than one ground point 46.

Figure 6:
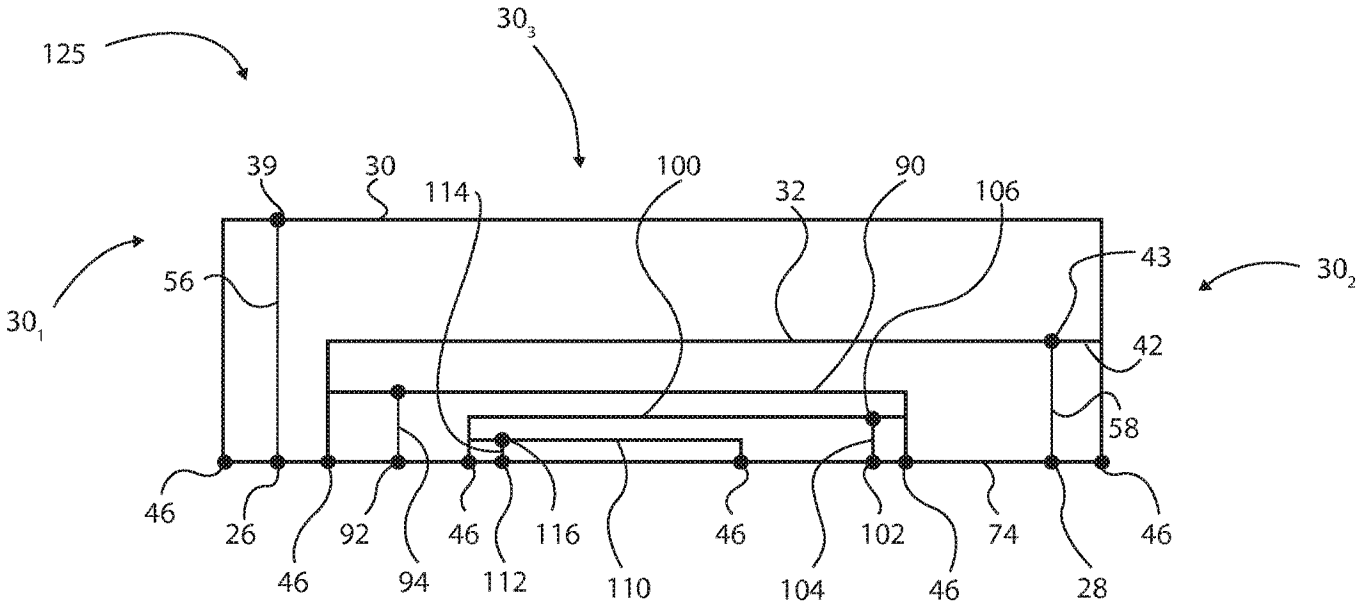
FIG. 6 illustrates a schematic plan view diagram of an alternative apparatus according to various examples.

FIG. 6 illustrates a schematic plan diagram of an alternative apparatus 125 according to various examples. The apparatus 125 is similar to the apparatus 121, 123, and 124 illustrated in FIG. 2, FIG. 4 and FIG. 5 and where the features are similar, the same reference numerals are used.

The apparatus 125 includes a first conductive member 30, a second conductive member 32, a third conductive member 90, a fourth conductive member 100, a fifth conductive member 110, a second edge 74 of a ground member 18 (not illustrated), a first feed point 26, second feed point 28, third feed point 92, fourth feed point 102, fifth feed point 112 and grounds 46. In the example embodiment of FIG. 6, five distinct antennas are now nested in the apparatus 125.

The first antenna comprises the first conductive member 30, first feed point 26, first elongate member 56, first coupling point 39, and at least a part of the ground member 18. The second antenna comprises the second conductive member 32, second feed point 28, second elongate member 58, second coupling point 43, and at least a part of the ground member 18. The third antenna comprises the third conductive member 90, third feed point 92, third elongate member 94, third coupling point 96, and at least a part of the ground member 18. The fourth antenna comprises the fourth conductive member 100, fourth feed point 102, fourth elongate member 104, fourth coupling point 106, and at least a part of the ground member 18. The fifth antenna comprises the fifth conductive member 110, fifth feed point 112, fifth elongate member 114, fifth coupling point 116, and at least a part of the ground member 18.

The third, fourth and fifth antennas are smaller than the first and second antennas, and the fifth antenna is the smallest in terms of physical dimensions. Thus the natural resonant operational frequency is higher for the fifth antenna than for the fourth antenna, and the natural resonant operational frequency is higher for the fourth antenna than for the third antenna, and so on. The first antenna has a natural resonant operational frequency which is the lowest of all five antennas.

Figure 7:
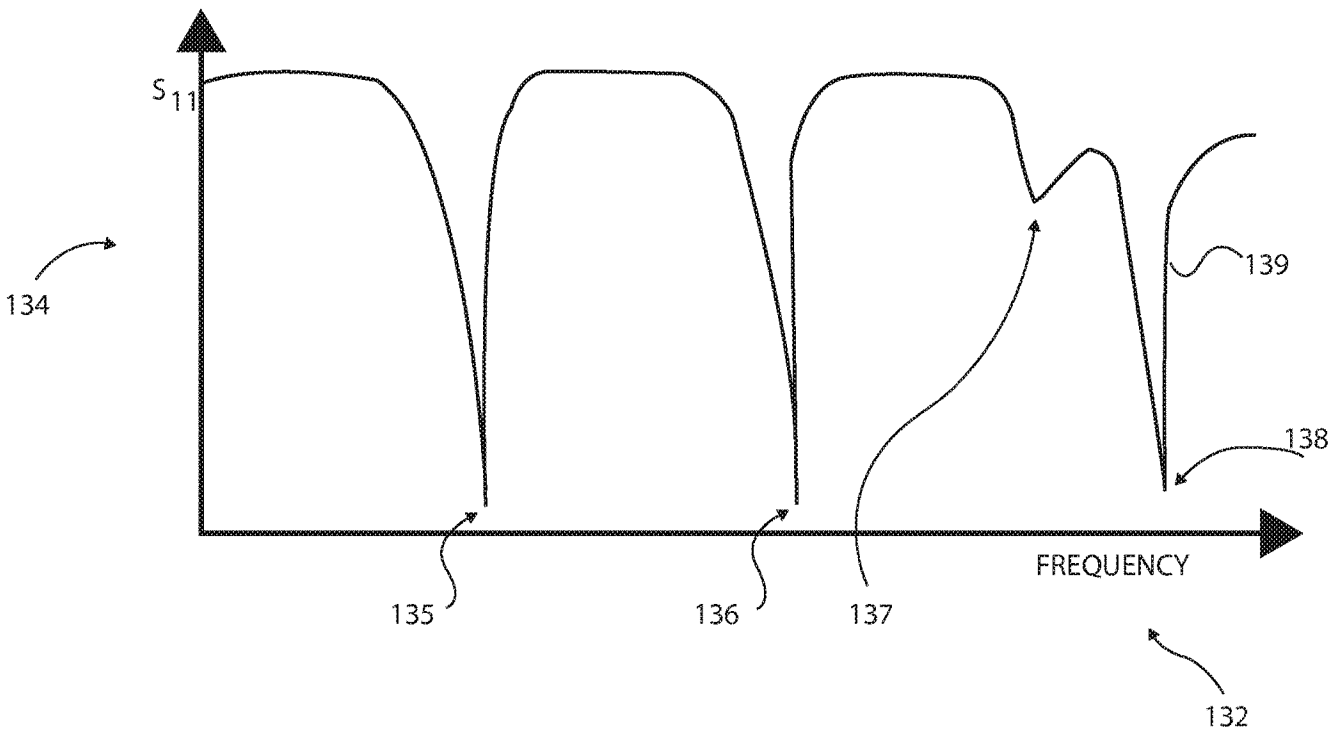
FIG. 7 illustrates a graph of the magnitude of the scattering parameter S11 (dB) versus frequency (GHz) for an apparatus operating at Global Positioning System (GPS) frequencies according to various examples.

FIG. 7 illustrates a graph 130 of the magnitude of the scattering parameter S11 (dB) versus frequency (GHz) for the first antenna, a GPS antenna, of the apparatus illustrated in FIG. 5. The graph 130 includes a horizontal axis 132 for frequency and a vertical axis 134 for the magnitude of the scattering parameter S11. The graph 130 also includes a line 139 that represents how the magnitude of the scattering parameter S11 of the apparatus 124 varies with frequency.

The line 139 includes a first minimum 135 at a first frequency, a second minimum 136 at a second frequency (higher than the first frequency), a third minimum 137 at a third frequency (higher than the second frequency) and a fourth minimum 138 at a fourth frequency (higher than the third frequency).

The first minimum 135 corresponds to an operational resonant frequency (where electrical length $L=\lambda/2$) of the first antenna. The second minimum 136 corresponds to an operational resonant frequency (where electrical length $L=\lambda$) of the first antenna. The third minimum 137 corresponds to an operational resonant frequency (where electrical length $L=3\lambda/2$) of the first antenna. The fourth minimum 138 corresponds to an operational resonant frequency of the second antenna, the WLAN antenna.

The frequency of the first minimum 135 is determined at least in part by the electrical length of the first conductive member 30. The frequency of the second minimum 136 is determined at least in part by the electrical length of the first conductive member 30. The frequency of the third minimum 137 is determined at least in part by the electrical length of the first conductive member 30. The frequency of the fourth minimum 138 is determined at least in part by the electrical length of the second conductive member 32 which is a parasitic resonance coupled electromagnetically from the second antenna to the first antenna.

Figure 8:
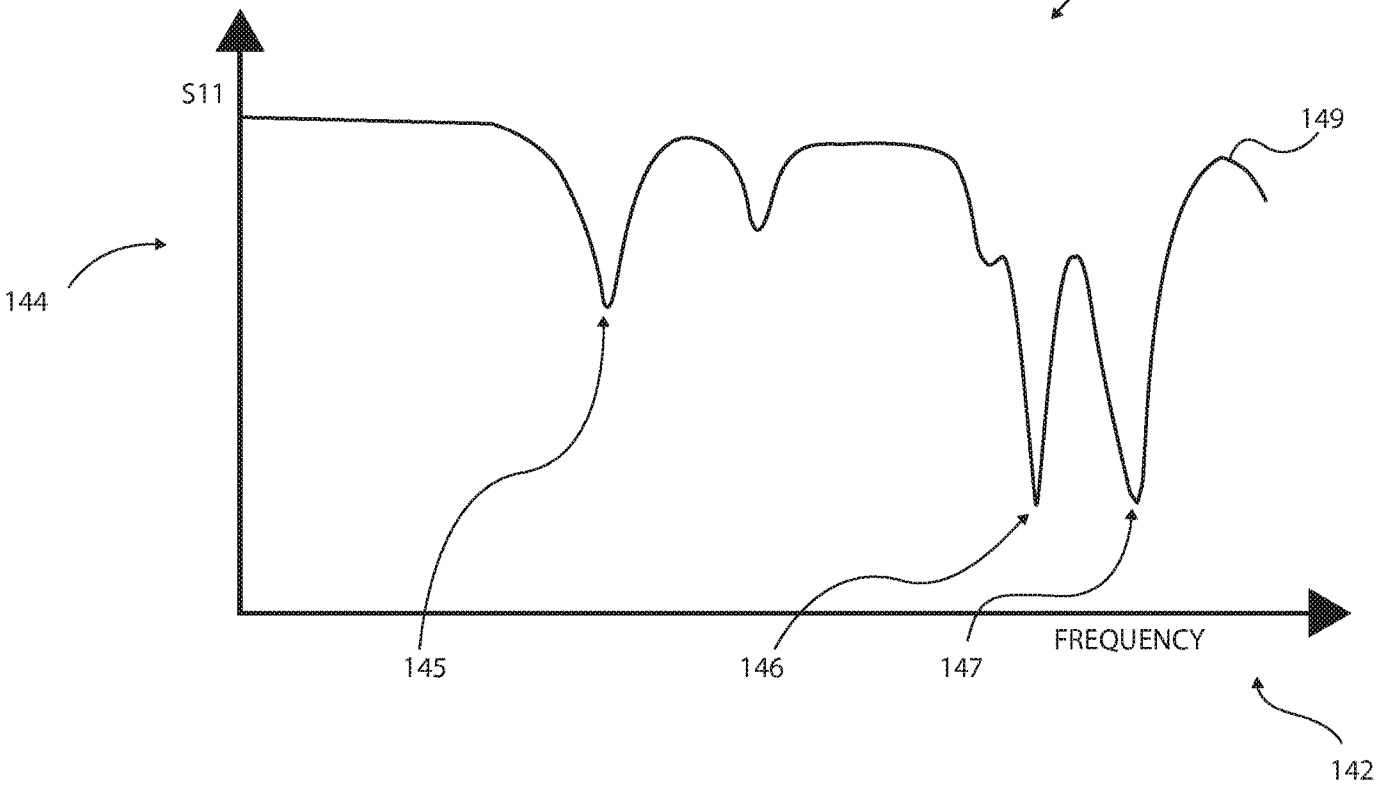
FIG. 8 illustrates a graph of the magnitude of the scattering parameter S11 (dB) versus frequency (GHz) for an apparatus operating at Wireless Local Area Network (WLAN) frequencies according to various examples.

FIG. 8 illustrates a graph 140 of the magnitude of the scattering parameter S11 (dB) versus frequency (GHz) for the second antenna, a WLAN antenna, of the apparatus illustrated in FIG. 5. The graph 140 includes a horizontal axis 142 for frequency and a vertical axis 144 for the magnitude of the scattering parameter S11. The graph 140 also includes a line 149 that represents how the magnitude of the scattering parameter S11 of the apparatus 124 varies with frequency.

The line 149 includes a first minimum 145 at a first frequency, a second minimum 146 at a second frequency (higher than the first frequency), and a third minimum 147 at a third frequency (higher than the second frequency).

The first minimum 145 corresponds to an operational resonant frequency (where electrical length $L=\lambda/2$) of the second antenna. The second minimum 146 corresponds to an operational resonant frequency (where electrical length $L=\lambda$) of the second antenna. The third minimum 147 corresponds to an operational resonant frequency of the first antenna.

The frequency of the first minimum 145 is determined at least in part by the electrical length of the second conductive member 32. The frequency of the second minimum 146 is determined at least in part by the electrical length of the second conductive member 32. The frequency of the third minimum 147 is determined at least in part by the electrical length of the first conductive member 30, which is a parasitic resonance coupled electromagnetically from the first antenna to the second antenna.

Figure 9:
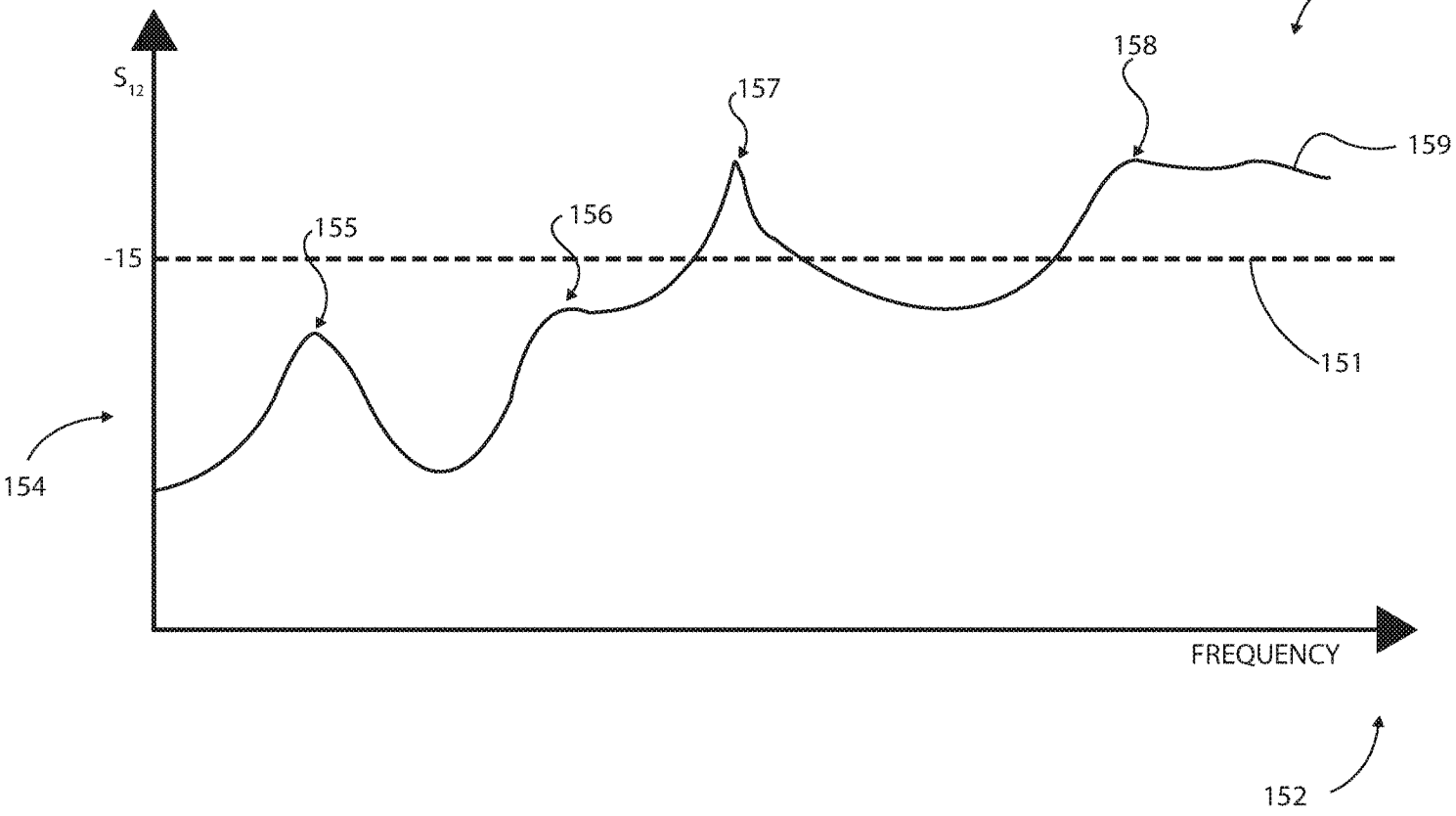
FIG. 9 illustrates a graph of the magnitude of the scattering parameter S12 (dB) versus frequency (GHz) for an apparatus operating at Global Positioning System (GPS) and Wireless Local Area Network (WLAN) frequencies according to various examples.

FIG. 9 illustrates a graph 150 of the magnitude of the scattering parameter S12 (dB) versus frequency (GHz) for the antenna of the apparatus illustrated in FIG. 5. The graph 150 includes a horizontal axis 152 for frequency and a vertical axis 154 for the magnitude of the scattering parameter S12. The graph 150 also includes a line 159 that represents how the magnitude of the scattering parameter S12 of the apparatus 124 varies with frequency.

The line 159 includes a first maximum 155 at a first frequency, a second maximum 156 at a second frequency (higher than the first frequency), a third maximum 157 at a third frequency (higher than the second frequency), and a fourth maximum 158 at a fourth frequency (higher than the third frequency).

The graph 150 also includes a line 151 that represents an isolation threshold limit of −15 dB versus frequency. The first maximum 155 corresponds to an isolation level at a first operational frequency band of the first antenna, in this example the GPS frequency band, which is below the isolation threshold limit and there is therefore acceptable isolation between the first and second antennas at the first operational frequency band. The second maximum 156 corresponds to an isolation level at a second operational frequency band of the second antenna, in this example the WLAN frequency band, which is below the isolation threshold limit and there is therefore acceptable isolation between the first and second antennas at the second operational frequency band. The third maximum 157 corresponds to an isolation level at a second operational frequency band of the first antenna which is above the isolation threshold limit, but this harmonic resonance of the first antenna has a frequency which is not required in the example embodiment, as the resonant frequency does not fall within an operational frequency band, and can therefore be ignored in the overall RF system design. The fourth and fifth maximums 158, 159 correspond to an isolation level at two higher order modes or harmonic resonant frequencies of the first and second antennas which are above the isolation threshold limit and there is therefore an unacceptable isolation between the first and second antennas at the fourth and fifth maximums. The fourth and fifth maximums 158, 159 fall within an operational frequency band of the second antenna (5 GHz WLAN Band). However, even though the isolation between the first antenna and the second antenna is above the threshold limit of −15 dB, this frequency can be easily filtered out by a filter disposed at the first antenna (GPS) since the operational frequencies of the first antenna operate at around 1.575 GHz (GPS) which is far away in the frequency spectrum from 5 GHz.

Figure 10:
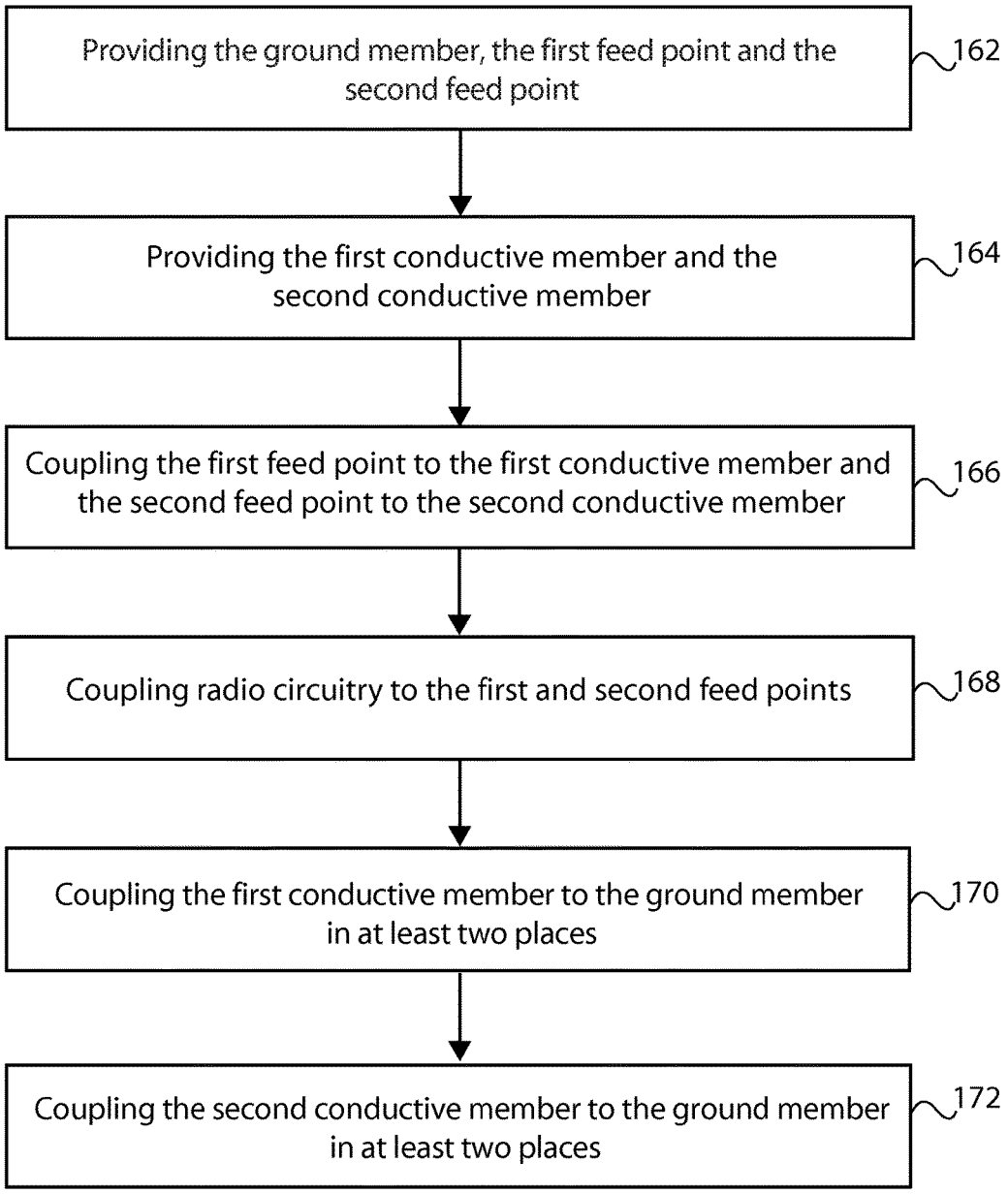
FIG. 10 illustrates a flow diagram of a method of manufacturing an apparatus according to various examples.

FIG. 10 illustrates a flow diagram of a method of manufacturing an apparatus according to various examples. At block 162, the method includes providing the ground member 18.

At block 164, the method includes providing the first conductive member 30 and the second conductive member 32. The first conductive member 30 (and optionally the second conductive member 32) may be formed by either pressing, casting or stamping a section of conductive material, for example metal, into the required shape, or by moulding a support structure which is then plated in metal to form the first conductive member 30. Optionally, the first conductive member 30 may be further processed to remove burrs or blemishes generated on the part during the pressing, casting or stamping phase by, for example, grinding or polishing the first conductive member 30.

At block 166, the method includes coupling the first feed point 26 to the first conductive member 30 (for example, via the first conductive elongate member 56) and the second feed point 28 to the second conductive member 32 (for example, via the second conductive elongate member 58).

At block 168, the method includes coupling radio circuitry 14 to the first and second feed points 26, 28.

At block 170, the method includes coupling the first conductive member 30 to the ground member 18 in at least two places via two or more ground points 46.

At block 172, the method includes coupling the second conductive member 32 to the ground member 18 in at least two places via two or more ground points 46.

The blocks illustrated in the FIG. 7 may represent steps in a method and/or sections of code in a computer program. For example, a controller may execute the computer program to control machinery to perform the method illustrated in FIG. 7. The illustration of a particular order to the blocks does not necessarily imply that there is a required or preferred order for the blocks and the order and arrangement of the block may be varied. Furthermore, it may be possible for some blocks to be omitted.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class.

Although embodiments of the present invention have been described in the preceding paragraphs with reference to various examples, it should be appreciated that modifications to the examples given can be made without departing from the scope of the invention as claimed.

For example, the first conductive member 30 may be any internal or external conductive part or parts of the electronic device and in some examples, the first conductive member 30 may be any part or parts of the housing 20.

Features described in the preceding description may be used in combinations other than the combinations explicitly described.

Although functions have been described with reference to certain features, those functions may be performable by other features whether described or not.

Although features have been described with reference to certain embodiments, those features may also be present in other example embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a first feed point coupled to a first conductive member, the first conductive member being coupled to a ground member at first and second ground points, the first conductive member and ground member defining a first perimeter, wherein the first conductive member and at least a portion of the ground member are configured to resonate at least partially in a first operational frequency band; and a second feed point coupled to a second conductive member, the second conductive member being disposed within the first perimeter, the second conductive member and at least a portion of the ground member defining a second perimeter which is smaller than the first perimeter, and being configured to resonate in a second operational frequency band, different to the first operational frequency band, wherein the second conductive member is coupled to the ground member in at least two places including at a third ground point disposed between the first and second feed points.

2. An apparatus as claimed in claim 1, further comprising a first conductive elongate member, wherein the first feed point is coupled to the first conductive member via the first conductive elongate member.

3. An apparatus as claimed in claim 1, further comprising a second conductive elongate member, wherein the second feed point is coupled to the second conductive member via the second conductive elongate member.

4. An apparatus as claimed in claim 1, wherein the first conductive member comprises first and second ends, the first end of the first conductive member being disposed opposite the second end of the first conductive member, and wherein the first conductive member is coupled to the ground member at the first ground point disposed proximate the first end of the first conductive member and at the second ground point disposed proximate the second end of the first conductive member.

5. An apparatus as claimed in claim 1, wherein the first conductive member is coupled to radio frequency circuitry via the first feed point, the first feed point disposed proximate the first end of the first conductive member and the second conductive member is coupled to radio frequency circuitry via the second feed point, the second feed point disposed proximate the second end of the first conductive member.

6. An apparatus as claimed in claim 5, wherein the first feed point, first ground point, and at least a portion of the first conductive member and the ground member define a first slot having a first slot area smaller than an area of the first perimeter.

7. An apparatus as claimed in claim 6, wherein the first feed point, first ground point and the first conductive member are to have a predetermined impedance matched to the first operational frequency band.

8. An apparatus as claimed in claim 5, wherein the second feed point, second ground point, and at least a portion of the second conductive member and the ground member define a second slot having a second slot area smaller than an area of the second perimeter.

9. An apparatus as claimed in claim 8, wherein the second feed point, second ground point and the second conductive member are to have a predetermined impedance matched to the second operational frequency band.

10. An apparatus as claimed in claim 4, wherein the second conductive member is configured to couple to the ground member at the second ground point disposed proximate the second end of the first conductive member in addition to the third ground point disposed between the first feed point and the second feed point.

11. An apparatus as claimed in claim 10, wherein the second feed point is disposed between the second ground point and the third ground point.

12. An apparatus as claimed in claim 10, wherein the third ground point is disposed closer to the first end of the first conductive member than the second end of the first conductive member.

13. An apparatus as claimed in claim 1, wherein at least a part of the first conductive member, first feed point, ground member, and second conductive member define a third perimeter disposed within the first perimeter, wherein the third perimeter is disposed outside of the second perimeter.

14. An apparatus as claimed in claim 1, wherein the first conductive member comprises a conductive housing portion of a housing, the housing defining an external surface of the apparatus.

15. An apparatus as claimed in claim 14, wherein the conductive housing portion comprises at least a part of at least one of an external lateral side surface and an external longitudinal side surface of a portable electronic device.

16. An apparatus as claimed in claim 14, wherein the conductive housing portion is at least a part of a bezel of a portable electronic device.

17. An apparatus as claimed in claim 10, wherein the second conductive member comprises first and second ends, the first end of the second conductive member being disposed opposite the second end of the second conductive member.

18. An apparatus as claimed in claim 10, wherein the second conductive member is coupled to the ground member via the third ground point and the second end of the first conductive member.

19. An apparatus as claimed in claim 10, wherein the first conductive member further comprises first, second and third edges; the second edge comprising the second end of the first conductive member; and the second end of the second conductive member is coupled to the second edge of the first conductive member.

20. A portable electronic device comprising:

a first feed point coupled to a first conductive member, the first conductive member being coupled to a ground member at a first ground point and a second ground point, the first conductive member and ground member defining a first perimeter, wherein the first conductive member and at least a portion of the ground member are configured to resonate at least partially in a first operational frequency band; and a second feed point coupled to a second conductive member, the second conductive member being disposed within the first perimeter, the second conductive member and at least a portion of the ground member defining a second perimeter which is smaller than the first perimeter, and being configured to resonate in a second operational frequency band, different to the first operational frequency band, wherein the second conductive member is coupled to the ground member in at least two places including at a third ground point disposed between the first and second feed points.

21. A method comprising:

providing a ground member, a first feed point and a second feed point;

providing a first conductive member;

coupling the first feed point to the first conductive member;

coupling the first conductive member to the ground member at a first ground point and a second ground point, such that the first conductive member and ground member define a first perimeter, and wherein the first conductive member and at least a portion of the ground member are configured to resonate in a first operational frequency band;

providing a second conductive member;

coupling the second feed point to the second conductive member; and coupling the second conductive member to the ground member in at least two places including at a third ground point disposed between the first and second feed points, such that the second conductive member and at least a portion of the ground member define a second perimeter, and wherein at least a portion of the ground member are configured to resonate in a second operational frequency band, different to the first operational frequency band.

22. A method as claimed in claim 21, further comprising:

providing a first conductive elongate member; and coupling the first feed point to the first conductive member via the first conductive elongate member.

23. A method as claimed in claim 21, further comprising:

providing a second conductive elongate member; and coupling the second feed point to the second conductive member via the second conductive elongate member.

* * * * *